US005408965A

United States Patent [19]

Fulton et al.

[11] Patent Number: 5,408,965

[45] Date of Patent: Apr. 25, 1995

[54] INTERNAL COMBUSTION ENGINE OIL PAN WITH OIL COOLER

[75] Inventors: Clarence W. Fulton; Dan E. Haynes, both of Oakville, Canada; Eugene E. Rhodes, Belleville; Williard E. Swenson, Bloomfield, both of Mich.

[73] Assignee: Ford Motor Company, Dearborn, Mich.

[21] Appl. No.: 131,162

[22] Filed: Oct. 4, 1993

[51] Int. Cl.[6] ..... F01M 5/00; F01P 11/08

[52] U.S. Cl. ..... 123/196 AB; 184/104.3; 29/890.042

[58] Field of Search ..... 123/196 AB, 195 C; 184/106, 104.3; 165/170, 171; 29/890.039, 890.041, 890.042

[56] References Cited

U.S. PATENT DOCUMENTS

| | | | |
|---|---|---|---|
| 1,197,121 | 9/1916 | Herr . | |
| 1,536,499 | 5/1925 | Horvath . | |
| 1,721,525 | 7/1929 | Mougey | 123/196 AB |
| 1,906,538 | 5/1933 | Church . | |
| 1,958,156 | 5/1934 | Whelan . | |
| 1,969,864 | 8/1934 | Tebaldi . | |
| 1,991,618 | 2/1935 | Lyman . | |
| 2,487,215 | 11/1949 | Blatt . | |
| 2,782,008 | 2/1957 | Caughill . | |
| 3,301,230 | 1/1967 | Ito . | |
| 3,334,398 | 8/1967 | Middleton | 29/890.042 |
| 3,371,399 | 3/1968 | Miller | 29/890.042 |
| 3,384,946 | 5/1968 | Ward, Jr. | 29/890.042 |
| 3,408,723 | 11/1968 | Myers | 29/890.042 |
| 3,782,134 | 1/1974 | Meess et al. | 165/170 |
| 3,831,246 | 8/1974 | Morris | 29/157.3 V |
| 4,021,901 | 5/1977 | Kleine et al. | 29/890.042 |
| 4,150,655 | 4/1979 | Gaggiano et al. | 123/196 AB |
| 4,209,886 | 7/1980 | Winter et al. | 29/890.042 |
| 4,898,261 | 2/1990 | Winberg et al. | 184/6.22 |

*Primary Examiner*—Willis R. Wolfe
*Assistant Examiner*—Erick Solis
*Attorney, Agent, or Firm*—Jerome R. Drouillard; Roger L. May

[57] ABSTRACT

An engine oil pan includes a reservoir for oil flowing from the engine and a heat exchanger for cooling the oil, with the heat exchanger having at least one passage formed by fluid expansion.

22 Claims, 3 Drawing Sheets

INTERNAL COMBUSTION ENGINE OIL PAN WITH OIL COOLER

FIELD OF THE INVENTION

The present invention relates to an engine oil pan or reservoir having provisions for circulating cooling fluid therethrough for the purpose of removing heat from lubricating oil circulating through the engine.

BACKGROUND OF THE INVENTION

Internal combustion engines subjected to severe service, such as certain automotive engines, frequently input a great deal of heat to the lubricating oil. It is commonly known that lubricating oil cannot function properly if it is maintained at excessive temperatures for prolonged periods of time. In response to the need to keep oil temperatures within reasonable limits, it is commonly been known to use oil coolers in conjunction with internal combustion engines. Construction of an oil cooler for an internal combustion engine requires special care inasmuch as the cooling fluid, which is commonly a water/ethylene glycol solution circulated between the engine's radiator and the cylinder block, must not be allowed to come in contact with the engine's lubricating oil. If coolant leaks into the lubricating oil, the engine's bearings may be quickly ruined because the mixture of lubricating oil and coolant provides very little lubricity. Accordingly, it is imperative that an oil cooler have structural integrity such that intermixing of the engine coolant and lubricating oil will not occur. It is known to use roll bonded evaporators in the refrigeration art, but automotive oil coolers are commonly made of built-up of fin and tube type units having many separate subassemblies consolidated into a single unit by means of numerous joints, all of which may leak. An oil pan having an oil cooler according to the present invention provides the required structural integrity because no tube joints are included in the fluid passages within the oil pan, notwithstanding that a heat exchanger according to the present invention may have a large surface area due to many internal passages.

It is an advantage of the present invention that an oil pan may be equipped with a heat exchanger according to this invention at a reasonable cost, and without sacrificing structural integrity of the oil cooler.

SUMMARY OF THE INVENTION

According to the present invention, an oil pan for an internal combustion engine includes a reservoir adapted for mounting on the lower side of an engine to collect oil, and a heat exchanger mounted within the reservoir, with the heat exchanger comprising a structure having at least one passage for circulating cooling fluid, with the passage being formed in the structure by means of fluid expansion. The heat exchanger preferably comprises a sandwich of at least two sheets of pattern bonded metal, with the coolant passages being formed by applying fluid pressure between the bonded sheets such that the metal in the unbonded portions of the sheets and pattern will expand. The metal sheets preferably comprise two roll bonded aluminum sheets, with the passages being formed in the heat exchanger by gas blowing of the aluminum sheets. In a preferred embodiment, the oil reservoir has side panels in contact with both the cylinder block of the engine and a bottom panel, with the heat exchanger being arranged such that it conforms to the sides and bottom of the reservoir. In this case, the heat exchanger will comprise a multi-planar, roll-bonded aluminum tray having a center section extending substantially the entire length of the reservoir, and upwardly extending sections within the sump region of the reservoir. Oil flowing into the reservoir will come into contact with the heat exchanger, which of course is cooled by engine coolant flowing therethrough, and as a result,, the temperature of the oil will be reduced. According to yet another aspect of the present invention, a method for making a heat exchanger for an engine oil cooler comprises the steps of printing a pattern defining at least one fluid passage on a metallic base sheet, bonding the base sheet to a mating sheet such that the printed pattern defines areas which remain unbonded after the bonding has occurred, forming passages by forcing a fluid under pressure between the sheets such that the unbonded areas of the sheets are filled with fluid and expanded, and further forming the expanded sheets into a multi-planar configuration which may be housed within an engine oil pan.

DETAILED DESCRIPTION OF THE PREFERRED EMBODIMENTS

Figure 1:
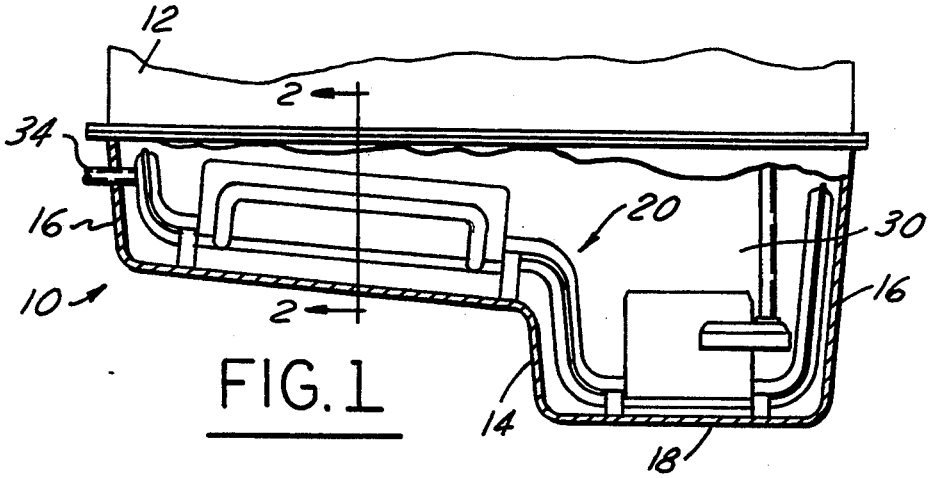
FIG. 1 is a sectional view of an oil pan, partially in elevation, including a heat exchanger according to the present invention.

As shown in FIG. 1, oil pan 10 has a reservoir 14 for collecting oil flowing from engine cylinder block 12. Oil pan 10 is mounted to the lower side of cylinder block 12 in conventional fashion. Heat exchanger 20 is mounted within reservoir portion 14 of oil pan 10. As shown clearly in FIG. 1, heat exchanger 20 is multi-planar and generally conforms to sides 16 and bottom 18 of reservoir 14. Because heat exchanger 20 conforms with the sides and bottom of reservoir 14, it is possible to achieve a maximum amount of surface area for convective cooling of the oil flowing over the heat exchanger. Heat is extracted from the oil because engine coolant, or some other cooled fluid, is circulated through passages in heat exchanger 20 by means of connections 34.

Figure 2:
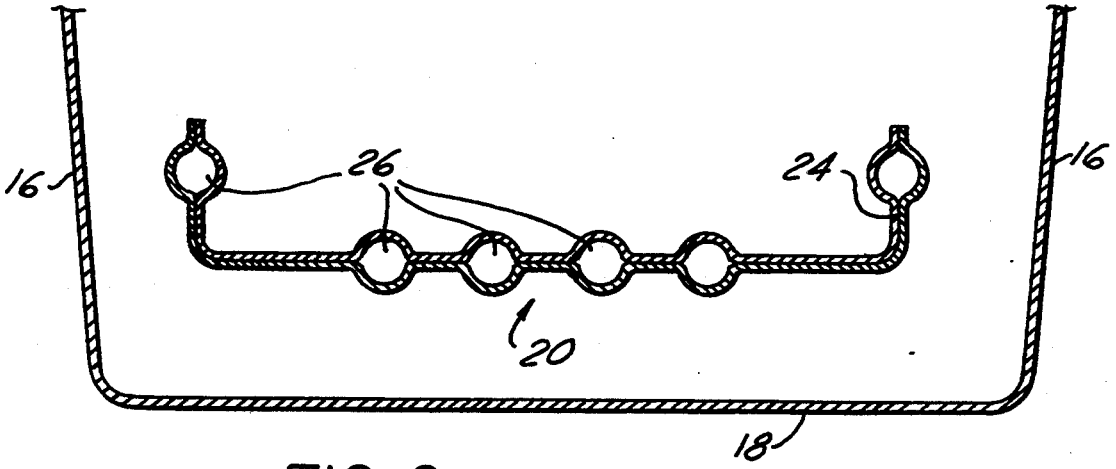
FIG. 2 is a cross-sectional view taken on a plane indicated by and viewed in the direction of the arrows 2—2 of FIG. 1.

FIG. 2 is a sectional view illustrating details of construction of heat exchanger 20. In general, a series of passages 26 is formed between base sheet 22 and mating sheet 24.

Figure 3:
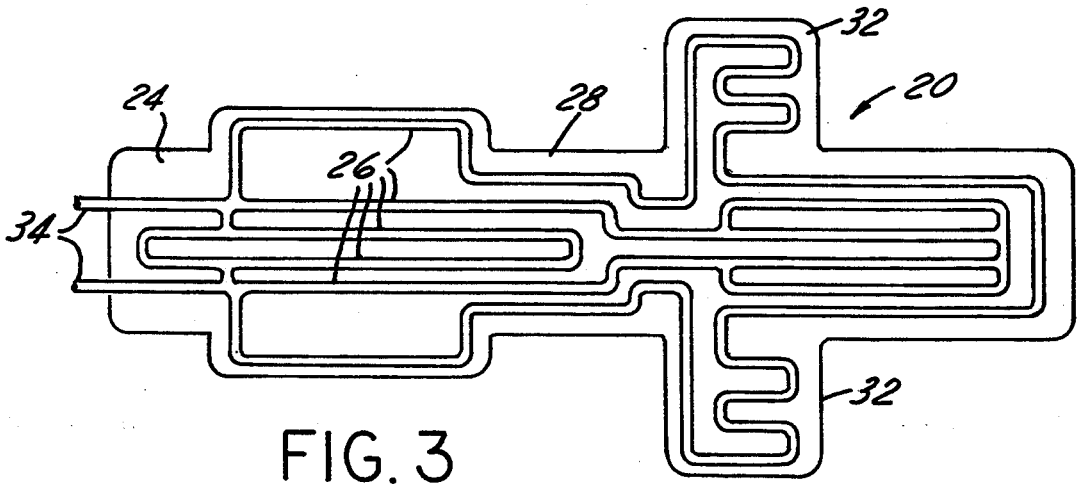
FIG. 3 is a plan view of a heat exchanger according to the present invention shown after the sheets have been bonded and expanded but prior to the final working of the sheets until multi-planar structure conforming to the shape of the oil pan.
Figure 4:
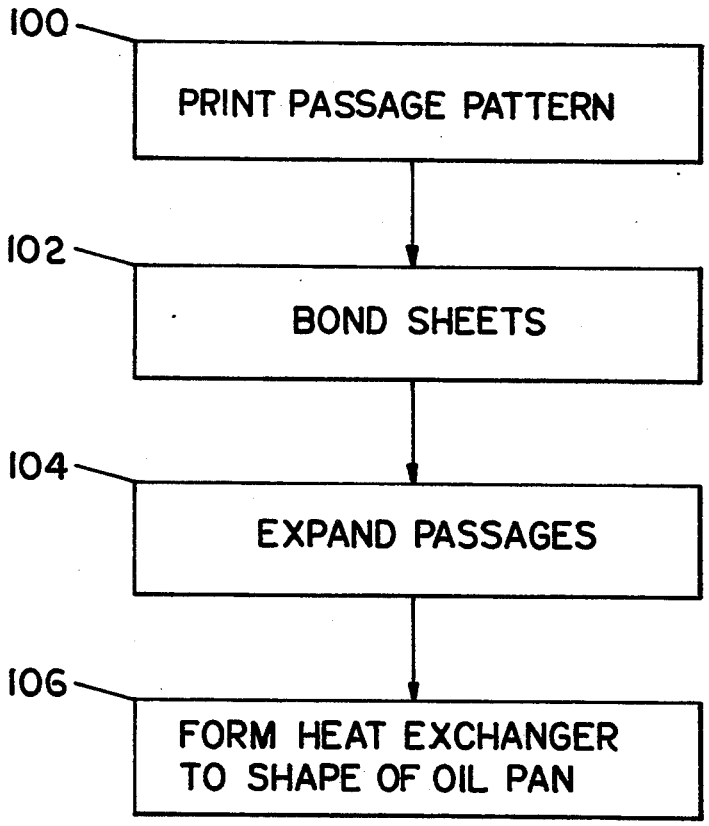
FIG. 4 is a flow chart showing processing of a heat exchanger according to the present invention.

Cooling passages 26 are formed from the parent metals of base sheet 22 and mating sheet 24 by forcing a fluid under pressure between the sheets after they have been bonded. This process is shown in FIG. 4. The process begins at block 100 with the printing of the pattern shown in FIG. 3 upon base sheet 22. The pattern may comprise a system having a plurality of passages or just a single passage. The design of the passages will depend upon the complexity of the part and the operating parameters to which the heat exchanger is subjected. Those skilled in the art will appreciate in view of this disclosure that other types of patterns could be chosen, as well as other types of final configurations for a heat exchanger according to the present invention. In any event, once a pattern is screen printed on the base sheet, the sheets are bonded together at block 102 by a roll-bonding process in the event that aluminum is used. Such roll-bonding is known to those skilled in the art of working aluminum. Once the sheets are bonded, the passages are expanded at block 104 by filling the passages with fluid under pressure. In the case of bonded aluminum, gas is commonly used, with the bonded sheets being placed between two rigid plates to control the expansion of the passages according to the distance between the two rigid plates. Following the expanding step of block 104, the expanded heat exchanger is formed into the shape of oil pan 10. In addition to two sheets of pattern bonded metal, a heat exchanger and oil pan according to the present invention could be made of plastics which are thermal bonded and then expanded, or bonded by other means and then expanded. Similarly, a heat exchanger could be made of blow molded plastic or other types of plastic molding operations. In any event, in order to achieve maximum surface area it is generally desirable to form the heat exchanger into a tray having a center section extending substantially the entire length of the reservoir and upwardly extending sections within the sump region of the reservoir shown generally in the area extending above the bottom 18 of the reservoir. Those skilled in the art will further appreciate in view of this disclosure that an oil pan according to the present invention could be constructed with one of the sheets comprising the heat exchanger being unitary with the oil reservoir, such that the heat exchanger sheet comprises at least a portion of the reservoir. For example, the heat exchanger could comprise a mating sheet applied to the upper side of bottom 18.

Figure 5:
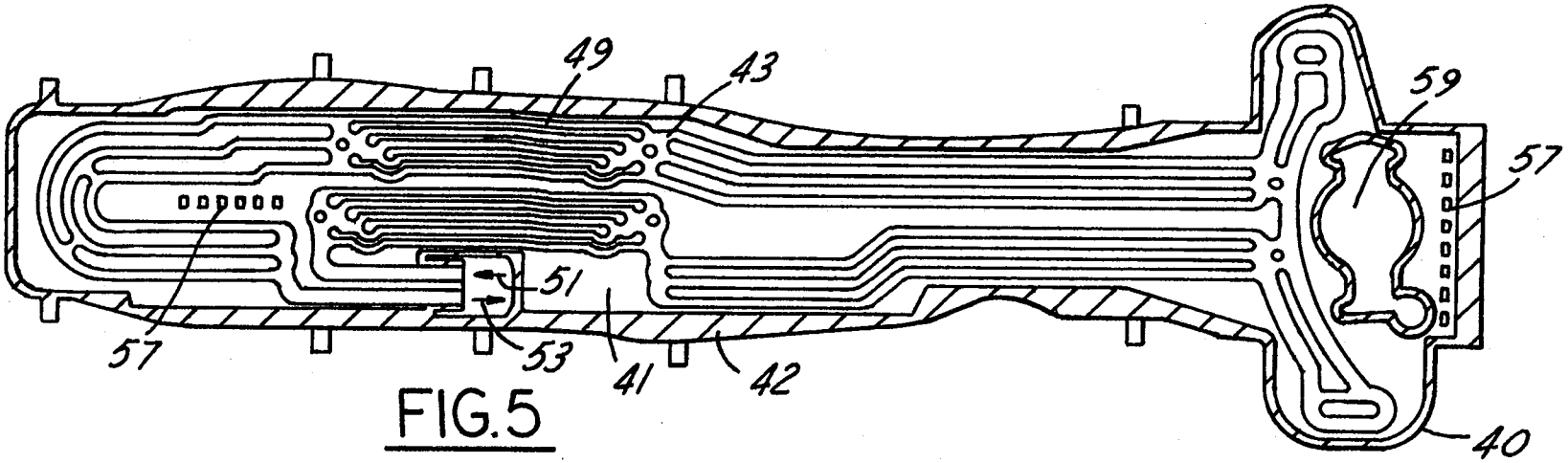
FIG. 5 is a plan view of a metallic base sheet having a printed pattern defining the areas of bonding and the areas to remain unbonded. The heat exchanger produced would be an alternate design to that shown in FIG. 3.

FIG. 5 is a plan view of a metallic base sheet 40 showing a printed pattern defining the areas of bonding 41 and the areas to remain unbonded 43. Area 42 is an additional area of bonding that is reserved during the design of the heat exchanger for contact with other forming tooling. During development of the heat exchanger, no changes are permitted in this area of the design. The specific pattern printed on base sheet 40 is designed to be roll bonded to a similarly shaped mating sheet (not shown) and subsequently formed into a heat exchanger 50, shown in FIG. 6. The printed pattern defines wide passages 45 which are designed to collect coolant flow from several narrower passages 47, which in turn collect coolant flow from even narrower passages 49. In designing, an attempt should be made to maintain fluid flow constant throughout the entire series of passages. Accordingly, for example, if three passages (such as passages 47) flow into one larger passage (such as passage 45) then the internal cross-sectional area of the larger passage should equal the aggregate internal cross-sectional areas of the smaller passages.

Wide passages 45 are used near the inlet connection point 51 and the outlet connection point 53 for the heat exchanger to maintain coolant fluid flow rates at desired levels. Multiple narrow passages 49 may be used in areas subject to forming bends. Narrow passages 49 span the U-shaped bend 63 of the heat exchanger shown in FIG. 6. After inflation of the passages in the roll bonded heat exchanger, the forming of bends tends to collapse the passages. Narrow passages tend to collapse less during bending operations than wider passages, so it is preferred in some cases to use narrower passages in areas of the heat exchanger that will be bent during forming.

The use of multiple passages increases the heat transfer into the coolant flowing through the passages because multiple passages have a greater surface area than a single passage designed to carry the same volume of coolant. However, other means for increasing the heat transfer into the coolant can be useful in connection with the present heat exchangers.

Increasing the flow path of the coolant flowing through the passages has been found to increase the heat transfer from the metal heat exchanger to the coolant flowing through it. The path length of the coolant flowing through the passages can be increased by causing it to flow in a helical pattern around the perimeter of the tube. Diagonal or other effective patterns of indentations or score lines embossed or etched in the surface of the metallic base sheet or the mating sheet in the area that will be unbonded and thus ultimately form the interior of a passage will promote the helical flow pattern and increase the heat transfer between the heat exchanger and the coolant. Diagonal indentations cause the fluid to spin within the passage in much the same way that rifling causes a bullet to spin as it passes down the barrel of a gun.

Indentations can also be produced during inflation of the passages. In a common practice, the uninflated, roll bonded sheet is placed between two parallel dies during inflation and the thickness of the passages is restrained at a predetermined height during inflation. The passages thus produced have an oval shape with a flat top and bottom. By replacing the flat dies with dies having a pattern of ridges, small indentations would be produced in the top and bottom of the passages during inflation.

Figure 7:
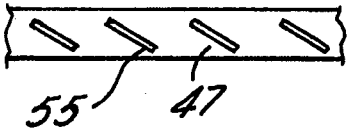
FIG. 7 is an enlarged view of an alternate printed pattern for a portion of the unbonded area which defines passage 47 shown in FIG. 5.

Another technique for promoting helical flow within the passages is illustrated in FIG. 7. In this figure, unbonded area 47 defines a passage in the roll bonded heat exchanger. Optional diagonal areas 55 are bonded areas in the middle of unbonded area 47. Bonded areas 55 are relatively thin and small compared to other bonded areas in the pattern and, as a result, produce relatively weak bonds. During inflation, bonded areas 55 will break leaving a pattern of rough diagonal broken bond areas on the inside of the passage defined by unbonded area 47. These rough areas will tend to urge the coolant to flow in a helical path and increase the heat transfer. Other techniques for producing a pattern of rough areas may be employed, such as sand blasting or chemical etching with a mask defining the pattern. Generalized roughness on the inside of the passages should be avoided, however, because it will slow down the flow of the coolant. Preferably, the pattern of rough areas or ridges produces the desirable helical flow pattern without slowing the rate of flow of the coolant.

In addition, it is believed that the materials and techniques used in printing the patterns which define the bonded and unbonded areas can effect the flow of the coolant through the passages. After inflation of the passages, a seam will be exposed on each side of the passage. Efforts should be made to make this seam as smooth as possible to maximize the flow rate of the coolant through the passage. Pattern materials having small particles will produce a smoother seam than pattern materials having larger particle sizes. Similarly, the use of printing screens having small openings will produce smoother seams. Larger openings tend to produce a sawtooth effect along the seam.

As shown in FIG. 5, base sheet 40 is provided with holes 57 which act primarily as vent and drain holes, but which also have the effect of increasing the heat transfer from the oil surrounding the heat exchanger to the heat exchanger because they increase the surface area of the heat exchanger in contact with the oil. If the punch-outs for the holes are left attached to the base sheet as tabs and after forming are bent so that they protrude from the base sheet, then the heat transfer will be further increased by the increased surface area. Other holes and/or tabs can be provided in other locations of the base sheet and the mating sheet provided that they do not interferer with the passages.

Heat transfer from the oil to the heat exchanger can also be increased by the provision of fins or other surface area increasing appendages attached to the outside of the heat exchanger. The fins should be of a heat conducting material, preferably the same metal that the heat exchanger is produced from, and firmly attached to the heat exchanger to promote good heat transfer from the fin to the heat exchanger. Skiving can also be used to increase the exterior surface area of the heat exchanger. The application of this known technique to improve heat transfer involves making a series of shallow angled cuts into the surface of the metal and then bending the shaving of metal up so that it protrudes from the surface without breaking or otherwise detaching the shaving from the surface of the metal.

Hole 59 is provided to facilitate installation around the oil pump in the particular design shown. Obviously, specific design criteria must be adopted for each engine oil pan to accommodate other components and to facilitate installation of the oil pan.

Figure 6:
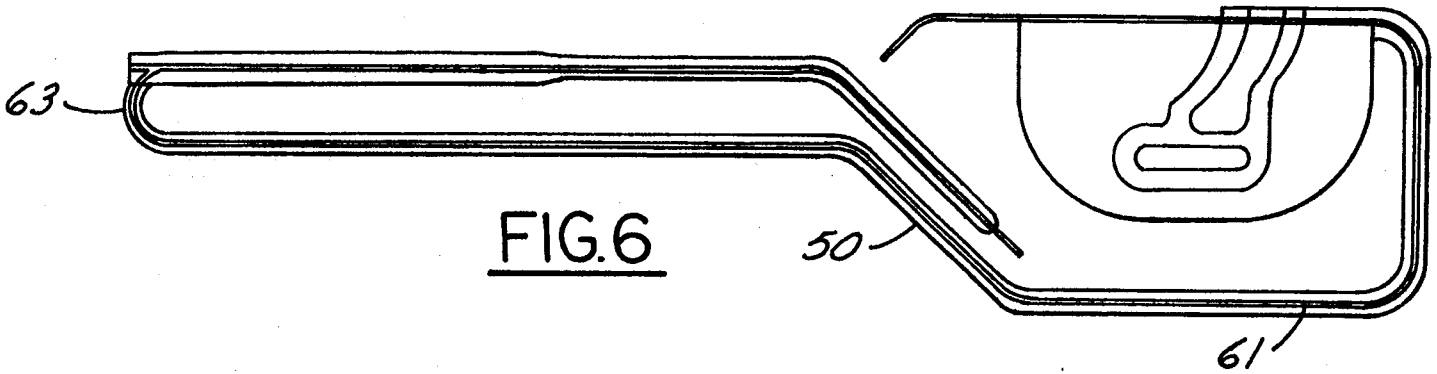
FIG. 6 is a side view of a heat exchanger produced from the base sheet shown in FIG. 5.

FIG. 6 shows a side view of a heat exchanger produced from the base metal sheet shown in FIG. 5. This heat exchanger can be produced using the process described in FIG. 4 or it can be produced by a modified process in which the heat exchanger is formed to the shape of the oil pan before the passages are expanded. If the modified procedure is followed, the base sheet would be formed to a shape approximately as shown by edge line 61 and then the passages would be inflated. Some modification of the forming practice will be required in bend areas. During inflation of the passages, more stretching of the metal will occur on the outside of a bend radius than on the inside. Accordingly, some experimentation may be required to find the right combination of bending and inflation to produce the desired final shape. The use of shaped dies during inflation to restrain the inflated passages and produce a finished heat exchanger having the desired final shape may also be desirable. Inflation after forming to shape has the advantage of preventing the collapse of the passages during forming.

While the invention has been shown and described in its preferred embodiments, it will be clear to those skilled in the arts to which it pertains that many changes and modifications may be made thereto without departing from the scope of the invention.

We claim:

1. An oil pan for an internal combustion engine, said oil pan comprising:

a reservoir adapted for mounting on the lower side of an engine to collect oil, with the reservoir having side panels in contact with the cylinder block of the engine, and a bottom panel; and a heat exchanger mounted within said reservoir, with said heat exchanger comprising a multi-planar, roll bonded, aluminum tray having a center section extending substantially the entire length of the reservoir, and upwardly extending sections within a sump region of the reservoir.

2. An oil pan according to claim 1, wherein said heat exchanger comprises a sandwich of at least two sheets of pattern bonded aluminum, with said passages being formed by applying fluid pressure between the bonded sheets such that the metal in the unbonded portions of the pattern will expand.

3. An oil pan according to claim 2, wherein at least one of said sheets comprises a portion of said reservoir.

4. An oil pan according to claim 2, wherein said heat exchanger comprises two roll bonded aluminum sheets.

5. An oil pan according to claim 4, wherein said passages are formed in said heat exchanger by gas blowing of said aluminum sheets.

6. A combination oil pan and oil cooler for an internal combustion engine having a cylinder block, said oil pan comprising:

a reservoir adapted for mounting on the lower side of an engine so as to collect oil flowing from said cylinder block, with said reservoir having side panels in contact with both said cylinder block and a bottom panel; and a heat exchanger mounted within and generally conforming with the panels of said reservoir such that oil flowing into said reservoir will come into contact with said heat exchanger, with said heat exchanger comprising a multi-planar structure having at least one passage for circulating cooling fluid.

7. An oil pan according to claim 6, wherein said heat exchanger comprises a sandwich of at least two sheets of metal roll bonded in a pattern, with said heat exchanger having a plurality of passages formed by fluidly expanding the bonded sheet sandwich.

8. An oil pan according to claim 7, wherein at least a portion of said passages are provided with a pattern of ridges on the interior thereof adapted to promote helical flow of the circulating cooling fluid within the passages.

9. An oil pan according to claim 8, wherein said pattern is a series of diagonal ridges on at least one side of said passage.

10. An oil pan according to claim 7, wherein at least a portion of said passages are provided with a pattern of rough areas on the interior thereof adapted to promote helical flow of the circulating cooling fluid within the passages.

11. An oil pan according to claim 10, wherein said rough areas are produced by breaking a portion of the roll bonded pattern while expanding the bonded sheet sandwich.

12. An oil pan according to claim 7, wherein said heat exchanger further comprises protrusions from the surface thereof which increase the external surface area thereof.

13. An oil pan according to claim 12, wherein said protrusions are selected from the group consisting of fins attached to the external surface of said heat exchanger and tabs which are an integral part of said metal.

14. An oil pan according to claim 12, wherein said protrusions are produced by skiving at least a portion of the surface of the heat exchanger.

15. An oil pan according to claim 6 wherein engine coolant circulates through said passages.

16. A method for making a heat exchanger for an engine oil cooler, comprising the steps of:

printing a pattern defining at least one fluid passage on a metallic base sheet;

bonding said base sheet to a mating sheet such that the printed pattern defines areas which remain unbonded after the bonding has occurred;

forming the passages by forcing a fluid under pressure between the sheets such that the unbonded areas of the sheets are filled with fluid and expanded after forming the expanded sheets into a multi-planar configuration which may be housed within an engine oil pan, said multi-planar configuration conforming to the bottom and sides of the oil pan.

17. A method according to claim 16, wherein said sheets comprise aluminum bonded together by roll bonding.

18. A method according to claim 16, wherein said printed pattern is applied by screen printing.

19. A method according to claim 17, wherein the sheets are placed between parallel dies during forming of the passages, said dies restraining the expansion of at least some of said passages.

20. A method according to claim 19, wherein said sheets are placed between a pair of shaped dies during forming of the passages, said dies restraining the expansion of at least some of said passages.

21. A method according to claim 19, wherein said dies are substantially flat and have a pattern of ridges on the surface thereof which create indentations in the surface of at least a portion of the said passages.

22. A method according to claim 20, wherein said dies have a pattern of ridges on the surface thereof which create indentations in the surface of at least a portion of the said passages.

* * * * *